US005642989A

United States Patent [19]

Keddie

[11] Patent Number: 5,642,989

[45] Date of Patent: Jul. 1, 1997

[54] BOOSTER COMPRESSOR SYSTEM

[75] Inventor: David Keddie, Mississauga, Canada

[73] Assignee: National Compressed Air Canada Limited, Ontario, Canada

[21] Appl. No.: 542,586

[22] Filed: Oct. 13, 1995

[51] Int. Cl.[6] ..... F04B 49/00

[52] U.S. Cl. ..... 417/298; 417/301; 417/310; 417/441; 418/201.2

[58] Field of Search ..... 417/298, 301, 417/310, 440, 441; 418/97, 98, 201.2, DIG. 1

[56] References Cited

U.S. PATENT DOCUMENTS

| | | | |
|---|---|---|---|
| 4,147,475 | 4/1979 | Shoop et al. | 417/310 |
| 4,394,113 | 7/1983 | Bammert | 418/98 |
| 5,176,505 | 1/1993 | Horii et al. | 418/DIG. 1 |

FOREIGN PATENT DOCUMENTS

| | | | |
|---|---|---|---|
| 121291 | 5/1991 | Japan | 418/201.2 |
| 6307371 | 11/1994 | Japan | 418/DIG. 1 |

*Primary Examiner*—Charles G. Freay

*Attorney, Agent, or Firm*—Rader, Fishman & Grauer PLLC

[57] ABSTRACT

A booster compressor system modulates discharge pressure with a proportional regulator in fluid communication between the compressor discharge and a servo control for a valve to the compressor inlet. The servo control comprises a double acting piston connected to a valve control rod. In one embodiment, the proportional regulator is of a negative signal type and communicates to a side of the piston for urging the piston to a valve opening position. A valve closing pressure is applied by a non-relieving regulator in fluid communication between the compressor discharge and the other side of the servo control piston. As the discharge pressure increases, the proportional regulator out let pressure decreases thereby resulting in the servo control allowing the intake valve to the compressor inlet to close. This, in turn, reduces the compressor discharge pressure thereby resulting in the proportional regulator controlling the valve to partially open once more. In a second embodiment, the proportional regulator is of a positive signal type and communicates to a side of the piston for urging the piston to a valve closing position. A valve closing pressure is applied by a non-relieving regulator in fluid communication between the compressor discharge and the other side of the servo control piston.

13 Claims, 4 Drawing Sheets

BOOSTER COMPRESSOR SYSTEM

BACKGROUND OF THE INVENTION

1. Field of the Invention

The present invention relates to a booster compressor system.

2. Description of the Related Art

Mines require compressed air at a pressure of typically 250 or 350 psi. Many mine air supply lines deliver pressure at between 80 and 100 psi. Accordingly, in order to utilize the air from the air supply line, a booster compressor is employed in order to boost line pressure to the desired discharge pressure.

Many booster compressors operate on a pressure switch basis where, when desired discharge pressure is achieved, the inlet air is cut off and remains cut off until the discharge pressure drops to a predetermined level. A drawback with such a system is that it results in significant swings in discharge air pressure, as well as in inlet air pressure.

This invention seeks to overcome drawbacks of prior booster compressors.

SUMMARY OF THE INVENTION

According to the present invention, there is provided a booster compressor system, comprising: a screw compressor having a suction inlet and a high pressure outlets an inlet line connected between said suction inlet and a system inlet for connection to an air supply source at a supply pressure, an intake valve in said inlet line; an intake valve controller comprising a proportional regulator having a pressure inlet in fluid communication with said high pressure out let and a delivery outlet outputting a valve control pressure signal, said proportional regulator being a negative signal proportional regulator for delivering a pressure at said delivery outlet which is inversely proportional to a pressure at said pressure inlet, said delivery outlet valve control pressure signal arranged for urging said intake valve toward a valve open position.

BRIEF DESCRIPTION OF THE DRAWINGS

In the drawings which describe an example embodiment of this invention.

DETAILED DESCRIPTION OF THE PREFERRED EMBODIMENTS

Figure 1:
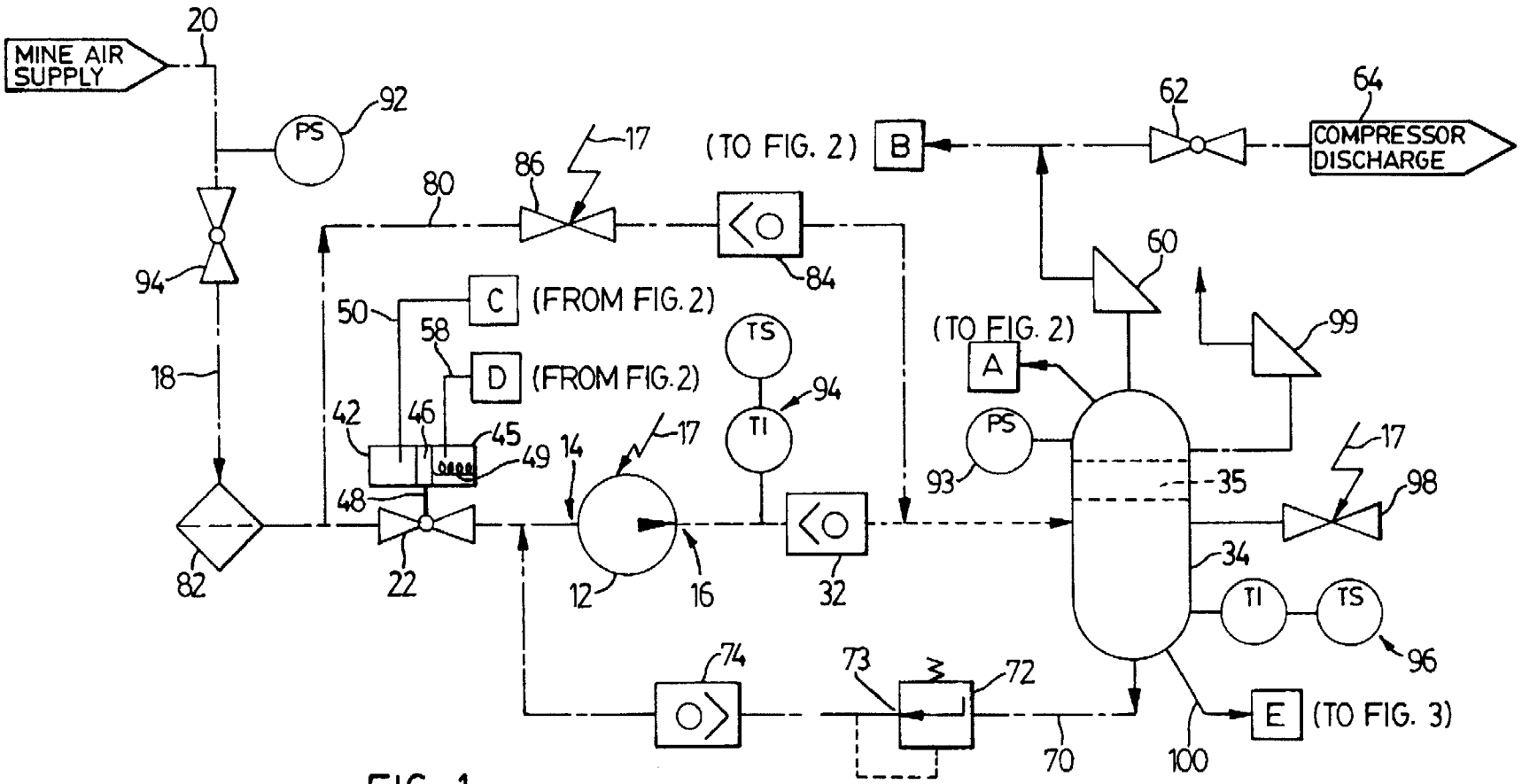
FIG. 1 is a schematic view of a port ion of a booster compressor system made in accordance with this invention.
Figure 2:
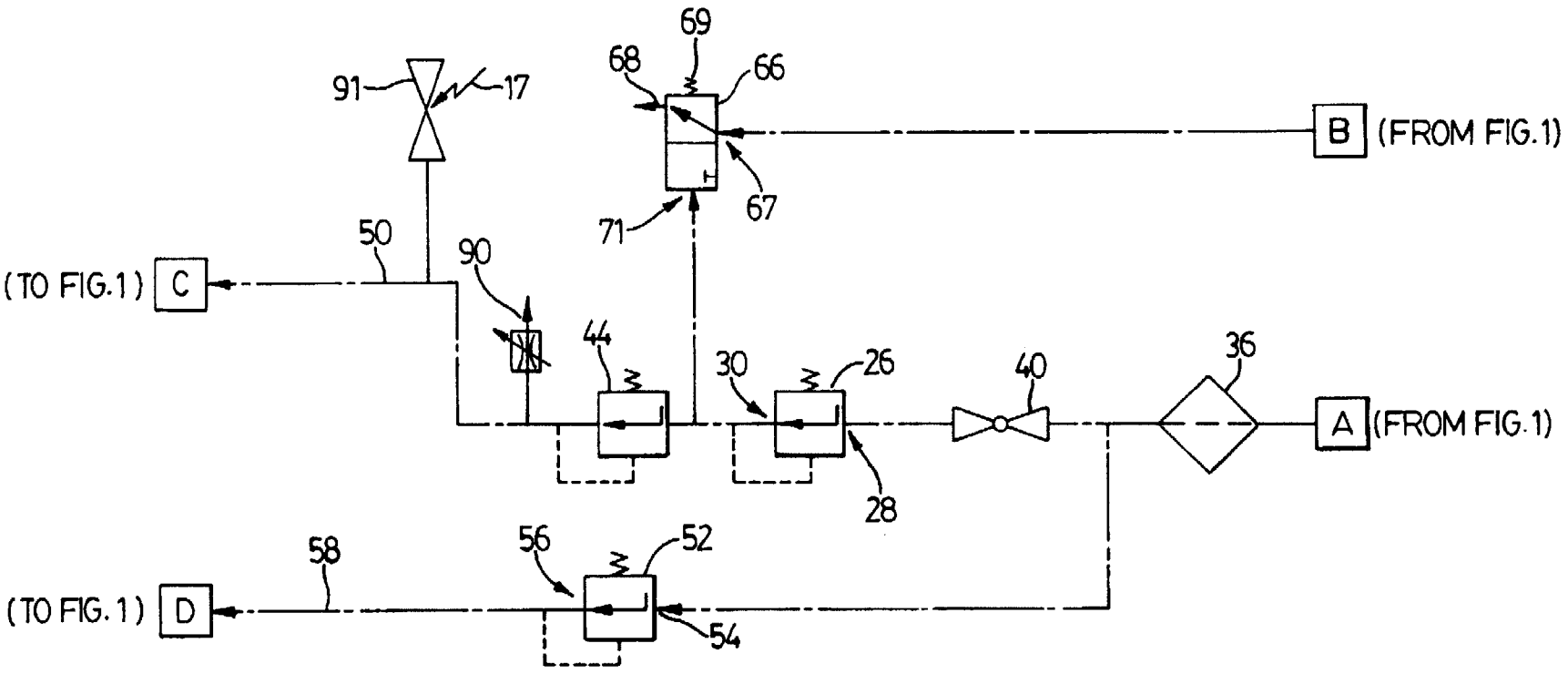
FIG. 2 is a schematic view of a further portion of a booster compressor system made in accordance with this invention.

Referring to FIGS. 1 and 2, a booster compressor system made in accordance with this invention comprises a compressor 12 having a suction inlet 14 and a high pressure outlet 16. The compressor is an oil flooded screw compressor which is energised by an electrical feed 17. An inlet line 18 is connected between the suction inlet 14 of the compressor and a system inlet 20 for connection to an air supply source at a supply pressure. A ball valve 94, a particulate and coalescing filter 82, and an intake valve 22 are serially arranged in the inlet line 18. A valve controller operatively associated with the intake valve 22 comprises a proportional regulator 26 having a pressure inlet 28 and a delivery outlet 30. The pressure inlet 28 is connected to the high pressure compressor outlet 16 through a one-way check valve 32, a pressure vessel 34, an oil filter 36, and an operator controlled isolation valve 40. The delivery out let is in communication with a servo drive 42 through a maximum pressure regulator 44 and an outlet line 50.

The proportional regulator 26 is of the negative signal type. This means that as the pressure at the pressure inlet increases (from a minimum level necessary for operation), the pressure at the delivery outlet decreases. The inverse proportionality between inlet and outlet pressure may be set by adjustment of the regulator. A suitable proportional regulator operating in this fashion is model P3N proportional regulator manufactured by Hoerbiger Ventilwerke AG of Vienna, Austria.

The valve actuating servo drive 42 comprises a cylinder 45 with a double acting piston 46 connected to a valve actuating rod 48 such that position of the piston controls position of the rod 48 and, therefore, the degree to which the intake valve is open. A spring 49 urges the piston 46 to a first position whereat the intake valve is closed. An example servo drive is a pneumatic actuator sold under the trademark COMPACTORQUE by Combraco Industries, Inc. Line 50 from the delivery outlet 30 of proportional regulator 26 is in fluid communication with cylinder 45 at one side of piston 46 such that pressure communicated to this side of the cylinder urges the piston to a second position whereat the intake valve is fully open.

A non-relieving regulator 52 has an air pressure inlet 54 in fluid communication with pressure vessel 34 through filter 36. Regulator 52 has an air pressure outlet 56 which communicates via line 58 to cylinder 45 of servo drive 42 at a side of piston 46 opposite that to the side to which line 50 communicates. Thus, pressure communicated to the cylinder from line 58 tends to urge piston 46 towards its first position whereat the intake valve 22 is closed. The non-relieving regulator is designed to communicate pressure to its outlet 56 at a pre-set level whenever the outlet pressure falls below the pre-set level (and the input pressure to the regulator exceeds this pre-set level).

The intake valve controller also comprises a quick exhaust valve 90 and a solenoid exhaust valve 91, both of which are in fluid communication with the outlet of maximum pressure regulator 44. The quick exhaust valve 90 is set to open when the pressure signal in line 50 declines below a pre-set level. The solenoid exhaust valve 91 is designed to open when not energized by energising feed 17.

Pressure vessel 34 communicates through a minimum pressure valve 60 and a ball valve 62 to a system discharge 64. The pressure vessel contains a fibrous separator 35 for separating oil from air. A bleed valve 66 has an inlet 67 connected to the system discharge 64 through ball valve 62, and an outlet 68 vented to atmosphere. The bleed valve is biased by spring 69 to a venting position and has a control inlet 71 in fluid communication with the delivery outlet 30 of proportional regulator 26.

A feedback line 70 extends between the pressure vessel 34 and the compressor suction inlet 14. The feedback line has a serially arranged maximum pressure regulator 72 and one-way check valve 74. The check valve 74 prevents flow toward the pressure vessel. The maximum pressure regulator limits the pressure at its outlet 73 to a pre-set maximum.

A by-pass line 80 extends from inlet line 18 between particulate and coalescing filter 82 and intake valve 22 on the one hand and pressure vessel 34 on the other. The by-pass line has a one-way check valve 84 preventing flow towards the inlet line and a solenoid valve 86 which opens when energized by electrical feed 17.

A low pressure cut-off switch 92 is positioned in sensing relation with inlet line 18 upstream of ball valve 94. A temperature sensor and a high temperature cut-off switch 94 are positioned in sensing relation with compressor outlet 16. A similar temperature sensor and a high temperature cut-off switch 96 are positioned in sensing relation with pressure vessel 34.

Pressure vessel 34 has a solenoid blow-down valve 98 which is maintained closed when energised by energising feed 17, and an emergency pressure relief valve 99.

Figure 3:
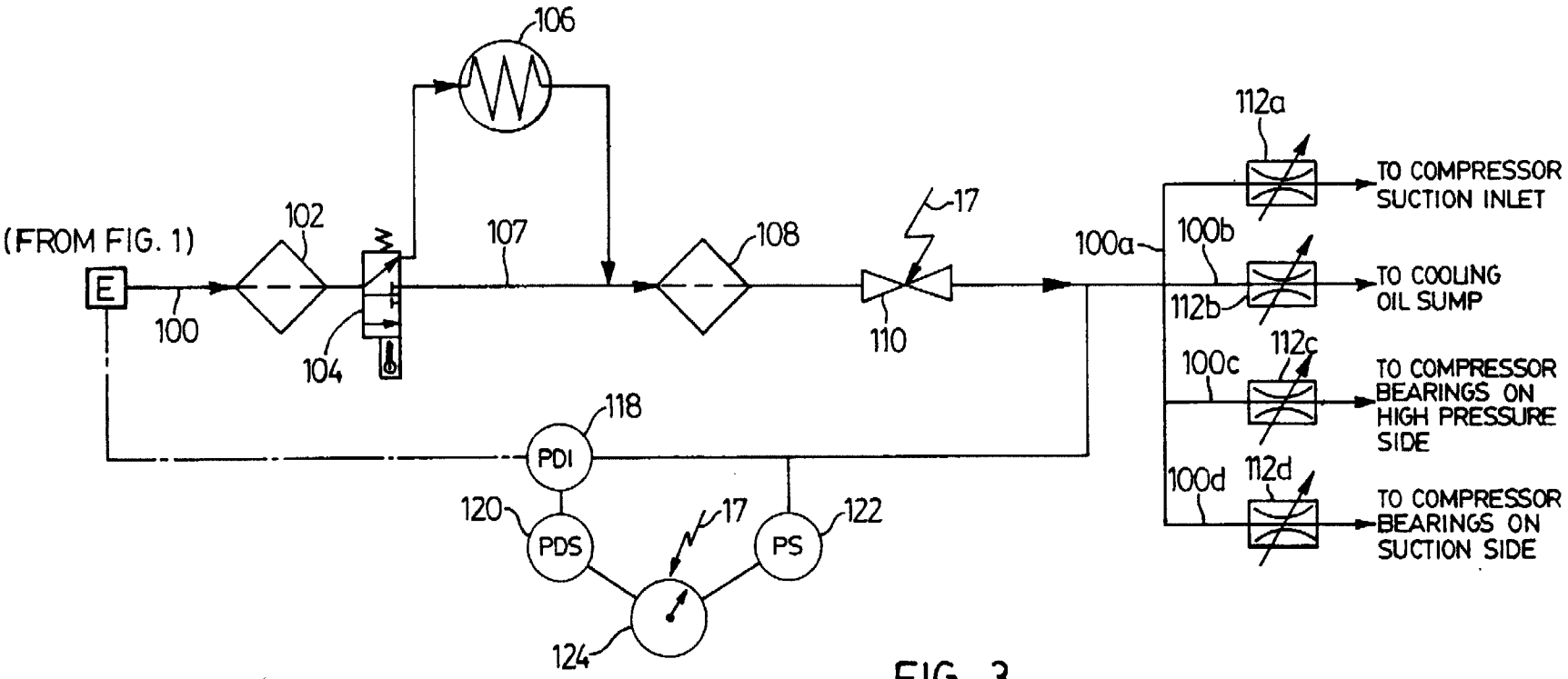
FIG. 3 is a schematic view of a further portion of a booster compressor system made in accordance with this invention.

Pressure vessel 34 has an oil outlet 100 in its base which, with reference to FIG. 3, feeds through an oil strainer 102, a thermostatic valve 104 which directs oil either through an oil cooler 106 or a short circuit 107 to oil filter 108, and a solenoid valve 110 which is open only when energised by electrical feed 17. Line 100 then branches into line **100*a* incorporating flow control 112*a* and leading to the compressor suction inlet, line 100*b* with flow control 112*b* and leading to a cooling oil sump, line 100*c* with flow control 112*c* and leading to the compressor bearings on the high pressure side and line 100*d* with flow control 112*d*** and leading to the compressor bearings on the suction side.

A pressure differential indicator 118 indicates the pressure difference at pressure vessel 34 and downstream of solenoid valve 110. A pressure switch 120 is operatively connected to the pressure differential sensor. A low pressure cut-off switch 122 is also connected to line 100 downstream of the solenoid valve 110. A timer 124 is connected to an enabling input of each of the pressure differential switch 120 and the low pressure switch 122. The timer is reset and enabled by energising feed 17.

Prior to start-up, solenoid exhaust valve 98 is open and, therefore, pressure vessel 34 is at atmospheric pressure. Because check valve 32 permits flow toward the pressure vessel, with the pressure vessel vented to atmospheric pressure, the compressor discharge 16 will also be at atmospheric pressure. Solenoid exhaust valve 91 is also open prior to start-up and isolation ball valve 40 is closed. In consequence, line 50 to servo 42 is at atmospheric pressure so that the piston 46 of the servo moves to its intake valve closing position under the influence of spring 49.

When the system is energized (by energising electrical feed 17), solenoid exhaust valves 91 and 98 close and solenoid valve 110 in line 100 and solenoid valve 86 in by-pass line 80 open. The opening of solenoid valve 86 allows air at supply pressure (of, for example 100 psi) in inlet line 18 to pass through ball valve 94 and particulate and coalescing filter 82, through the by-pass line, to the pressure vessel 34. This brings vessel 34 up to supply pressure. A lesser pressure set by maximum pressure regulator 72 is fed back from the pressure vessel to the pressure suction inlet on feedback line 70; this lesser pressure may be on the order of 60 psi.

The supply pressure in pressure vessel 34 is also communicated to non-relieving regulator 52 through filter 36. The non-relieving regulator in turn communicates a biasing pressure through line 58 to the servo drive 42 in order to bias intake valve 22 closed; this pressure may be on the order of 40 psi.

On start-up, compressor 12 is energized and begins to develop a suction at its inlet 14 and a positive pressure at its discharge 16. With valve 22 closed, if feedback line 70 were not present, a high vacuum would develop at the compressor inlet resulting in a high pressure differential across the compressor. This high pressure differential would severely stress the compressor. Pressure fed back from feedback line 70 avoids this high pressure differential and also allows the compressor to build a discharge pressure which is higher than the air supply pressure at system inlet 20. This discharge pressure also ensures that when the compressor suction inlet is later exposed to supply pressure, the pressure at compressor discharge 16 will already be higher than the supply pressure, thereby avoiding any reverse pressurization on the compressor which could damage same.

After energising the electrical feed 17, the operator may open isolation valve 40 whereupon air at supply pressure reaches the inlet 28 of proportional regulator 26; this results in the proportional regulator outputting a high pressure at its delivery outlet 30. This high pressure is communicated to the control inlet 71 of bleed valve 66 thereby forcing the bleed valve to a closed position. Maximum pressure regulator 44 sets the maximum pressure that is passed from the proportional regulator 26 to line 50; this maximum pressure may, for example, be set at 100 psi. The pressure in line 50 is communicated to servo drive 42 and forces piston 46 to a position at which intake valve 22 is fully open. (In this regard, it is noted that because regulator 52 is a non-relieving type, the pressure in line 58 increases from the maximum pressure passed by non-relieving regulator 52 as piston 46 is forced toward a position where valve 22 is open.) Air at supply pressure is then free to flow through inlet line 18 into the suction inlet 14 of the compressor 12. The compressor will then develop a discharge pressure at its outlet 16 above the desired system discharge pressure (of, for example, 350 psi). The discharge air is communicated through check valve 32 to pressure vessel 34, and through minimum pressure valve 60 (which opens when the pressure exceeds, for example, 150 psi) to ball valve 62 and system discharge 64.

The increased pressure at the discharge 16 of compressor 12 builds the pressure in vessel 34 and this increasing pressure is communicated from the pressure vessel to the inlet 28 of the proportional regulator 26. The increased pressure at the inlet of the proportional regulator will cause a proportional drop in pressure at the delivery outlet 30 of the regulator. When the outlet pressure drops below the maximum pressure level set by regulator 44, further decreases will be passed on to line 50. Thus, as the pressure in pressure vessel rises toward the desired system discharge pressure, pressure in line 50 begins to drop. At a certain point, the closing force on piston 46 exceeds the opening force such that piston 46 begins to move and partially closes intake valve 22. But as the piston begins to move, the closing pressure on the piston also drops until a new equilibrium position is established. Further pressure increases in the pressure vessel will result in the piston 46 moving further thereby further closing intake valve 22. The proportional regulator 26 is set such that when the pressure vessel reaches the intended system discharge pressure, the pressure in line 50 will drop to approximately atmospheric and the closing force on piston 46 will cause it to move to a position whereat the intake valve 22 is fully closed. Air pressure at the compressor inlet is now dictated by the set point of maximum pressure regulator 72. Consequently, the pressure developed at the discharge of compressor 16 now drops. When the pressure in pressure vessel also drops below desired pressure due to demand for compressed air from the discharge 64, the reduced pressure is communicated to the proportional regulator thereby again resulting in the intake valve at least partially opening, and so on. In this way, the pressure in the system discharge line 64 is modulated. This continuous modulation maintains the discharge pressure at a fairly constant level despite varying demands for discharge air.

To improve the response time of the modulation, quick exhaust valve 90 exhausts line 50 to atmosphere whenever the pressure signal from the outlet of maximum pressure regulator 44 declines below a pre-set level.

When the pressure signal from proportional regulator 26 declines below a certain level, bleed valve 66 opens thereby bleeding air from the system discharge. This also assists in maintaining the system discharge at the designed pressure point.

Oil in the base of pressure vessel 34 will be forced under pressure from the vessel through outlet line 100 to the various portions of the oil flooded screw compressor 12 requiring oil. In this regard, it will be noted that oil input to the compressor suction inlet vaporizes in the compressor and is entrained in the air leaving the compressor discharge 16. This entrained oil is separated in pressure vessel 34, due to both the reduction in air velocity in the vessel and separator 35. Separated oil falls to the base of the vessel.

Whenever the temperature of the oil in the system exceeds a preset amount, thermostatic valve 104 diverts the oil through an oil cooler 106 before the oil passes through oil filter 108.

If the mine air supply pressure falls below a minimum pressure for operation the pressure cut-off switch 92 will shut the system down. Similarly, if the temperature sensed by the temperature sensor arrangement 94 increases past a safe maximum, the temperature switch of this temperature sensing arrangement will shut the system down. Pressure switch 93 and temperature sensing arrangement 96 at pressure vessel 34 operate similarly. Relief valve 99 acts as an emergency pressure relief if the pressure vessel 34 rises above certain level, for example 385 psi.

When timer 124 is energised by feed 17, it is reset and begins to time; once the timer times out (for example, after one minute), the pressure difference switch 120 and low pressure switch 122 are enabled. Once enabled, if the pressure differential measured by indicator 118 is not below a preset maximum, then the pressure differential switch will shut the system down. The minimum pressure switch 122 also shuts the system down, once enabled, if the pressure is insufficient to cause oil to flow through system.

For a (non-emergency) shut down, the isolation valve is first closed by an operator. This cuts off the proportional regulator 26 from a source of air pressure so that the regulator is no longer able to provide a pressure signal at its delivery outlet 30. Consequently, bleed valve 66 opens and pressure in line 50 drops off so that the pressure from line 58 acts against piston 46 of the servo drive to close intake valve 22. With intake valve 22 closed, the pressure at the compressor inlet 14 will be set by the maximum pressure regulator 72. This pressure is less than air supply pressure which, therefore, allows the compressor discharge pressure to drop. Bleed valve 66 continues to bleed discharge pressure down. When the discharge pressure drops to the level set by minimum pressure valve 60, the minimum pressure valve closes. The system has now settled down sufficiently that the compressor may be shut down. When the electrical feed 17 is turned off to de-energise the compressor, solenoid blow-down valve 98 opens to vent the pressure vessel 34 to atmosphere.

Solenoid exhaust valve 91 opens whenever power is lost from feed 17. Thus, on any loss of power or emergency shutdown, exhaust valve 91 immediately opens to vent line 50 to atmosphere which will result in the immediate closing of the intake valve 22 to the compressor. Without this feature, the intake valve may remain open with the compressor stopped such that if there were any drop in the mine air supply pressure, air may flow from the pressure vessel through feedback line 70 toward the inlet line 18. However, air from the pressure vessel may entrain oil which would foul particulate and coalescing filter 82. A further potential problem should valve 22 remain open is that supply side air could drive the compressor. This would turn the compressor in a reverse direction to that for which it was designed thereby potentially damaging the compressor.

Non-relieving regulator 52 could be replaced with a relieving regulator. In such case the pressure in the end of cylinder 45 supplied by line 58 would remain constant even as piston 46 moved toward a valve opening position. However, the force imparted by spring 49 would still increase. If return spring 49 of servo control 42 is chosen sufficiently large, the non-relieving regulator 52 (or the optional relieving regulator) and line 58 to the servo valve may be unnecessary.

Where non-relieving regulator 52 is used, spring 49 may be replaced by an air line connected from the mine air supply directly to line 58 through a constant pressure regulator. This constant pressure regulator would ensure that whenever the system was shut down and connected to the mine air supply, the intake valve 22 would remain closed.

Figure 4:
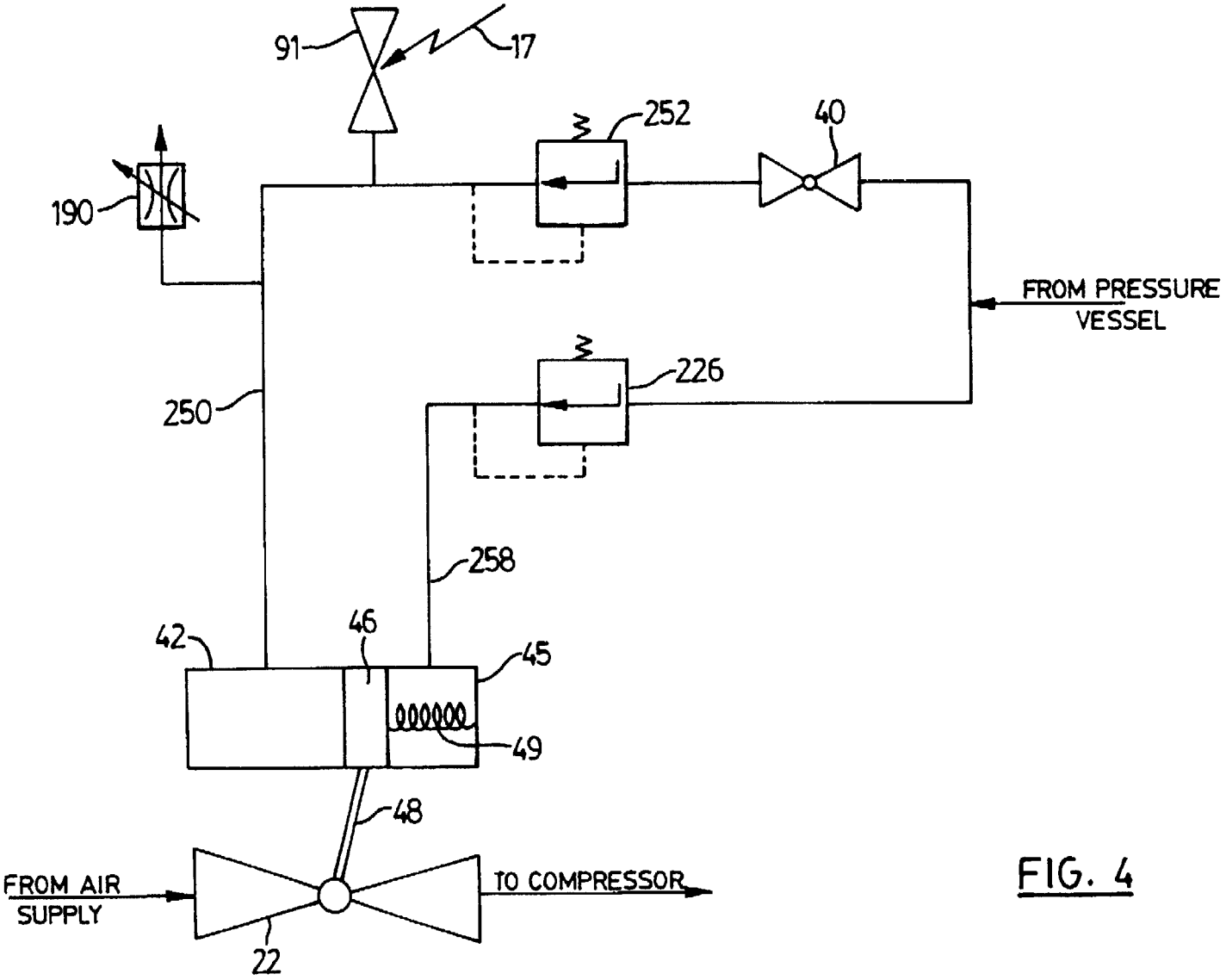
FIG. 4 is a schematic view of a port ion of a booster compressor made in accordance with another aspect of this invention.

FIG. 4 illustrates an optional valve control arrangement. Turning to FIG. 4, wherein like parts have been given like reference numerals, isolation valve 40 and a non-relieving regulator 252 are interposed between the pressure vessel and a line 250 extending to cylinder 42 at one side of piston 46. Solenoid exhaust valve 91 and a quick exhaust valve 190 are in fluid communication with line 250. A positive signal proportional regulator 226 is interposed between the pressure vessel and a line 258 to cylinder 42 at the other side of piston 46. The positive signal proportional regulator outputs a pressure signal directly proportional to, but less than, its input pressure.

In operation, prior to start up, isolation valve 40 is closed and solenoid exhaust valve 91 vents line 250 to atmosphere. Therefore, spring 49 urges piston 46 to a position whereat intake valve 22 is closed. On start-up, valve 91 will close. Also, pressure developed in the pressure vessel will be communicated to positive signal proportional regulator 226 which will communicate a proportional, but lesser, pressure signal to line 258. Once isolation valve 40 is opened by the operator, the non-relieving regulator 252 will communicate a pressure signal to line 250. The pressure setting of regulator 252 is chosen such that its pressure signal is initially sufficient to overcome spring 49 and the pressure signal from regulator 226 to thereby open valve 22. With valve 22 open, supply air feeds the compressor resulting in the pressure in the pressure vessel increasing. This increased pressure causes the positive signal proportional regulator 226 to pass an ever larger pressure signal whereas the pressure signal passed by the non-relieving regulator 252 is constant. Eventually, the force on piston 46 resulting from the pressure signal from regulator 226 and spring 49 exceeds the force exerted on the piston by the pressure signal from non-relieving regulator 252 such that the piston will move in a valve closing direction. However, since regulator 252 is non-relieving, this movement of the piston increases the pressure at the end of the cylinder fed by line 250; consequently, the piston moves to a new equilibrium position whereat valve 22 is partially closed. Further increases in pressure vessel pressure result in the valve 22 closing further. Once the back pressure in line 250 exceeds a pre-set level, quick exhaust valve 191 opens to exhaust line 250 to atmosphere allowing valve 22 to fully close. Pressure in the pressure vessel then begins to fall, resulting in the pressure signal from regulator 252 again beginning to overcome both the spring and pressure signal from regulator 226 to again begin to open the valve 22. Modulation continues in this fashion.

Other modifications will be apparent to those skilled in the art and, therefore, the invention is defined in the claims.

What is claimed is:

1. A boaster compressor system, comprising:

a screw compressor having a suction inlet and a high pressure outlet;

an inlet line connected between said suction inlet and a system inlet for connection to an air supply source at a supply pressure, an intake valve in said inlet line;

an intake valve controller comprising a proportional regulator having a pressure inlet in fluid communication with said high pressure outlet and a delivery outlet outputting a valve control pressure signal, said proportional regulator being a negative signal proportional regulator for delivering a pressure at said delivery outlet which is inversely proportional to a pressure at said pressure inlet, said delivery outlet valve control pressure signal arranged for urging said intake valve toward a valve open position.

2. The compressor of claim 1 wherein said valve controller comprises a further regulator having an air pressure inlet in fluid communication with said high pressure outlet and an air pressure outlet arranged for urging said intake valve toward a valve closed position.

3. The compressor system of claim 2 wherein said intake valve controller further comprises a valve actuating servo drive comprising a cylinder having a double acting piston connected to a valve actuator such that position of said piston controls position of said intake valve and, therefore, the degree to which said intake valve is open, said intake valve being fully closed when said piston is in a first position and said intake valve being fully open when said piston is in a second position, said negative signal proportional regulator being operatively connected to a side of said cylinder for urging said piston toward said second position and said further regulator being connected to a side of said cylinder for urging said piston toward said first position.

4. The compressor of claim 3 wherein said further regulator is a non-relieving regulator.

5. The compressor of claim 3 wherein said negative signal proportional regulator is arranged such that said valve control pressure signal is insufficient to open said intake valve when said proportional regulator pressure inlet senses a pressure at least as high as a first preset pressure and is sufficient to fully open said intake valve when said proportional regulator pressure inlet senses a pressure at least as low as a second preset pressure.

6. The compressor of claim 3 including an operator controllable isolation valve interposed between said high pressure outlet and said proportional regulator pressure inlet for isolating said negative signal proportional regulator, but not said further regulator, from said high pressure outlet, when closed.

7. The compressor of claim 3 including an exhaust valve between said proportional regulator delivery outlet and said servo drive, said exhaust valve closed only when energised, said exhaust valve being energised by an energising feed common to said screw compressor.

8. The compressor of claim 5 including a bleed valve having an inlet connected to said system discharge and an outlet vented to atmosphere, said bleed valve biased to an open position and having a bleed valve control inlet permitting said bleed valve to be closed when a pressure is applied to said control inlet in excess of a pre-set minimum pressure, said control inlet connected to said proportional regulator delivery outlet.

9. The compressor of claim 3 including a spring for urging said piston toward said first position.

10. The compressor of claim 1 including an oil separating pressure vessel interposed between a system discharge and said high pressure outlet, said pressure vessel having an oil outlet feeding an oil inlet of said screw compressor.

11. The compressor of claim 10 including a minimum pressure valve interposed between said pressure vessel and said system discharge.

12. The compressor of claim 11 including a one-way check valve between said high pressure outlet and said pressure vessel preventing flow toward said high pressure outlet and a feedback line between said pressure vessel and said suction inlet comprising a serially arranged feedback regulator and one-way check valve arranged to prevent pressure at said suction inlet from falling below at a pre-set minimum whenever the pressure in said pressure vessel exceeds said pre-set minimum.

13. The compressor of claim 12 including a by-pass line extending from said inlet line upstream of said intake valve and said pressure vessel, said by-pass line having a one-way check valve preventing flow toward the inlet line and a solenoid valve arranged to open on activation of said screw compressor, said by-pass line for pressurising said receiver to supply pressure on activation of said screw compressor.

* * * * *

UNITED STATES PATENT AND TRADEMARK OFFICE

CERTIFICATE OF CORRECTION

PATENT NO. : 5,642,989

DATED : Jul. 1, 1997

INVENTOR(S) : David Keddie

It is certified that error appears in the above-indentified patent and that said Letters Patent is hereby corrected as shown below:

Column 7, Line 13, delete "boaster" and insert "booster".

Signed and Sealed this

Sixteenth Day of September, 1997

*Attest:*

Bruce Lehman

BRUCE LEHMAN

*Attesting Officer*

*Commissioner of Patents and Trademarks*